US006574872B2

(12) United States Patent
Roberts et al.

(10) Patent No.: US 6,574,872 B2
(45) Date of Patent: Jun. 10, 2003

(54) UTILITY KNIFE

(75) Inventors: Craig Roberts, Sheffield (GB); Steve Rowlay, Sheffield (GB)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/848,287

(22) Filed: May 4, 2001

(65) Prior Publication Data

US 2002/0162229 A1 Nov. 7, 2002

(51) Int. Cl.[7] ..... B26B 5/00

(52) U.S. Cl. ..... 30/330; 30/124; 30/329; 30/340

(58) Field of Search ..... 30/160, 161, 124, 30/340, 335, 329, 330, 331

(56) References Cited

U.S. PATENT DOCUMENTS

| | | | | |
|---|---|---|---|---|
| 2,187,590 | A | | 1/1940 | Lurie |
| 3,509,627 | A | | 5/1970 | Gilbert et al. |
| 3,604,113 | A | | 9/1971 | Cuscovitch |
| 3,660,895 | A | | 5/1972 | West |
| 3,829,967 | A | | 8/1974 | Gilbert |
| 3,845,554 | A | | 11/1974 | Joanis et al. |
| 3,927,473 | A | | 12/1975 | Braginetz |
| 4,005,525 | A | | 2/1977 | Gringer |
| 4,068,375 | A | | 1/1978 | Rathbun et al. |
| 4,227,306 | A | | 10/1980 | Meshulam |
| 4,261,104 | A | | 4/1981 | Cuscovitch |
| 4,524,518 | A | | 6/1985 | West |
| 4,575,940 | A | | 3/1986 | Wenzel |
| 4,604,805 | A | | 8/1986 | Krieger |
| 4,662,070 | A | | 5/1987 | Reddig |
| 4,922,610 | A | | 5/1990 | Szabo |
| 4,936,014 | A | | 6/1990 | Shaanan et al. |
| 4,939,839 | A | | 7/1990 | Gorst |
| 5,005,290 | A | | 4/1991 | Gilbert |
| 5,301,428 | A | * | 4/1994 | Wilcox ..... 30/335 |
| 5,386,632 | A | | 2/1995 | Schmidt |
| 5,404,645 | A | | 4/1995 | Janser |
| 5,862,596 | A | | 1/1999 | Chung |
| 5,864,952 | A | | 2/1999 | Chung |
| 5,878,501 | A | | 3/1999 | Owens et al. |
| 5,940,970 | A | | 8/1999 | D'Ambro, Sr. et al. |
| 6,026,575 | A | | 2/2000 | Wonderley |
| 6,131,292 | A | | 10/2000 | Reddig |
| 6,163,963 | A | | 12/2000 | Huang |
| 6,233,830 | B1 | | 5/2001 | Lamond et al. |
| 6,330,749 | B1 | | 12/2001 | Khachatoorian et al. |
| 6,370,783 | B1 | * | 4/2002 | Bozikis et al. ..... 30/340 |

FOREIGN PATENT DOCUMENTS

| | | |
|---|---|---|
| WO | WO 88/06954 | 9/1988 |

* cited by examiner

*Primary Examiner*—Douglas D. Watts
(74) *Attorney, Agent, or Firm*—Pillsbury Winthrop LLP

(57) ABSTRACT

A cutting device wherein an illustrated embodiment can have two handles that are pivotable about a pivot axis between an open and a closed position while being permanently fastened together. A hand-activated securing and releasing mechanism pivots around the pivot axis and moves between a securing position rigidly securing the handles together in the closed position and a releasing position permitting the handles to freely move between the open and closed position. In the open position, the primary knife blade and its spares can be accessed. A one-piece gripping member can be secured to the knife to overlap both handles.

39 Claims, 15 Drawing Sheets

UTILITY KNIFE

FIELD OF THE INVENTION

The present invention relates generally to cutting devices. More specifically, the illustrated embodiment of the present invention relates to a utility knife having a pair of handles that can pivot about an axis relative to each other to expose an interior compartment.

BACKGROUND OF THE INVENTION

Cutting devices, such as utility knives, have been developed for use in various applications, such as, for example, construction, packaging and shipping, carpet installation, as well as other purposes.

Some utility knives include two mating halves secured to one another with a screw. A blade is fixed between the two halves and is released and replaced by removing the screw and separating the two halves. The screw is typically removed by using a screwdriver. Also, the two halves of these utility knives are often made from metal material.

SUMMARY OF THE INVENTION

One object of the illustrated embodiment of the invention is to provide a cutting device that allows for easy replacement of a knife blade.

Another object of the illustrated invention is to provide a cutting device that allows for easy replacement of a knife blade without disassembling the device.

Another object of the illustrated embodiment of the invention is to provide a cutting device with an improved grip.

These and other objects of the illustrated embodiment of the invention may be achieved by providing a cutting device comprising first and second handles coupled to one another such that the first and second handles can pivot relative to each other about a pivot axis between an open position in which a cavity formed between the first and second handles is open and accessible to a user and a closed position in which the cavity is closed, the first and second handles being permanently fastened to each other; a securing and releasing mechanism mounted for rotation about the pivot axis such that the securing and releasing mechanism rotates between a secure position in which the first and second handles are fixedly secured to each other and a release position in which the first and second handles are free to pivot about the pivot axis in a permanently fastened manner between the closed position and the open position, the securing and releasing mechanism being limited to the extent to which the securing and releasing mechanism can move away from the secure position so as to be unreleasably attached about the pivot axis; and a first knife blade being secured between the first and second handles.

The objects of the illustrated embodiments of the invention may be further achieved by providing a cutting device comprising first and second handles coupled together such that the first and second handles can pivot relative to each other about a pivot axis between an open position in which a cavity formed between the first and second handles is open and accessible to a user and a closed position in which the cavity is closed, the first handle having a first side portion and the second handle having a second side portion, which is opposite to the first side portion; a first knife blade being secured between the first and second handles; and a gripping member having a gripping surface formed of elastomeric material and coupled to at least one of the first and second handles, the gripping surface having a first side section, a second side section, and a bottom section positioned between the first and second side sections, the first side portion of the first handle and the first side section of the gripping surface forming a first side of the cutting device, and the second side portion of the second handle and the second side section of the gripping surface forming a second side of the cutting device, which is opposite to the first side of the cutting device, and the first and second handles being formed from material different than the elastomeric material of the gripping surface.

The objects of the illustrated embodiments of the invention may be further achieved by providing a cutting device comprising first and second handle members coupled to one another such that the first and second handle members can pivot relative to each other about a pivot axis between an open position in which a cavity formed between the first and second handle members is open and accessible to a user and a closed position in which the cavity is closed, the first handle member having a first side portion, an opposite second side portion, and a bottom portion positioned between the first and second side portion, the first and second side portions extending upwardly from the bottom portion to define, along with the bottom portion, a hollow pocket of the cavity, the bottom portion being split by a plane that is substantially perpendicular to the pivot axis, the first and second side portions being positioned on opposite sides of the plane, the first side portion of the first handle member forming a first side of the cutting device, the second side portion of the first handle member and the second handle member forming a second side of the cutting device, the second handle member configured such that in the open position, the second handle member is pivoted away from the pocket to permit access to the pocket, while in the closed position the second handle member blocks access to the pocket; and a first knife blade being secured between the first and second handle members.

Other objects, features, and advantages of the illustrated embodiment of the present invention and the present invention will become apparent from the following detailed description of the illustrated embodiment of the present invention, the accompanying drawings, and the appended claims.

BRIEF DESCRIPTION OF THE DRAWINGS

The illustrated embodiment of the present invention is further described in the detailed description which follows, by reference to the noted drawings by way of non-limiting exemplary embodiments, in which like reference numerals represent similar parts throughout the several views of the drawings, and wherein.

DETAILED DESCRIPTION OF A PREFERRED EMBODIMENT

Figure 1:
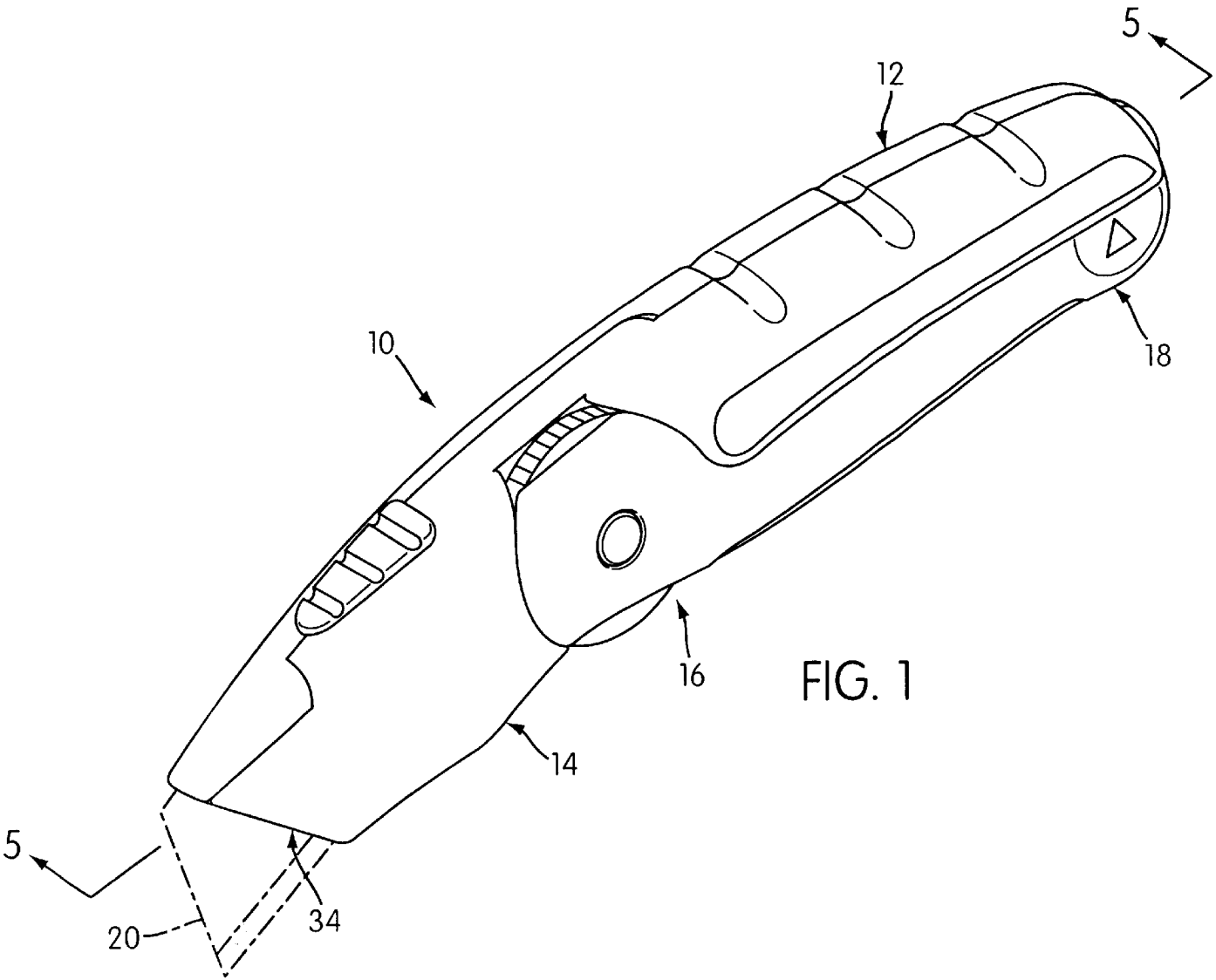
FIG. 1 is a perspective view of an illustrated embodiment of the present invention in the form of a cutting device with a knife blade shown in phantom.
Figure 2:
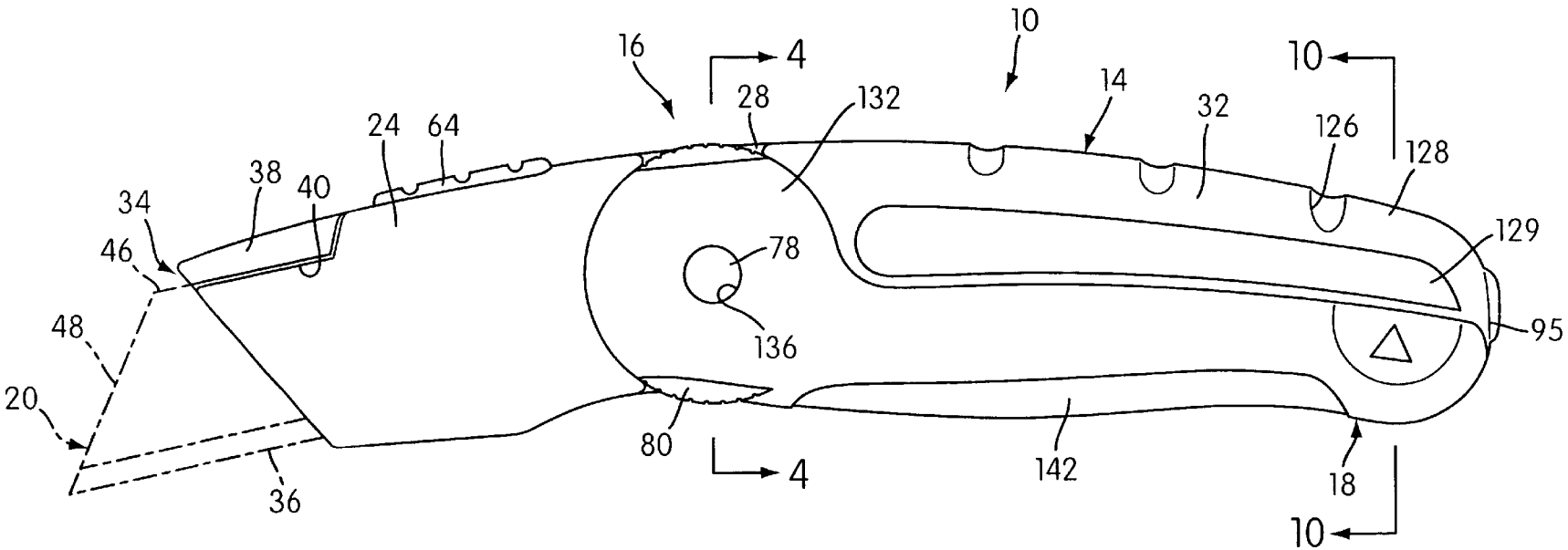
FIG. 2 is a side view of the cutting device shown in FIG. 1 showing the cutting device in a closed, operative position.
Figure 3:
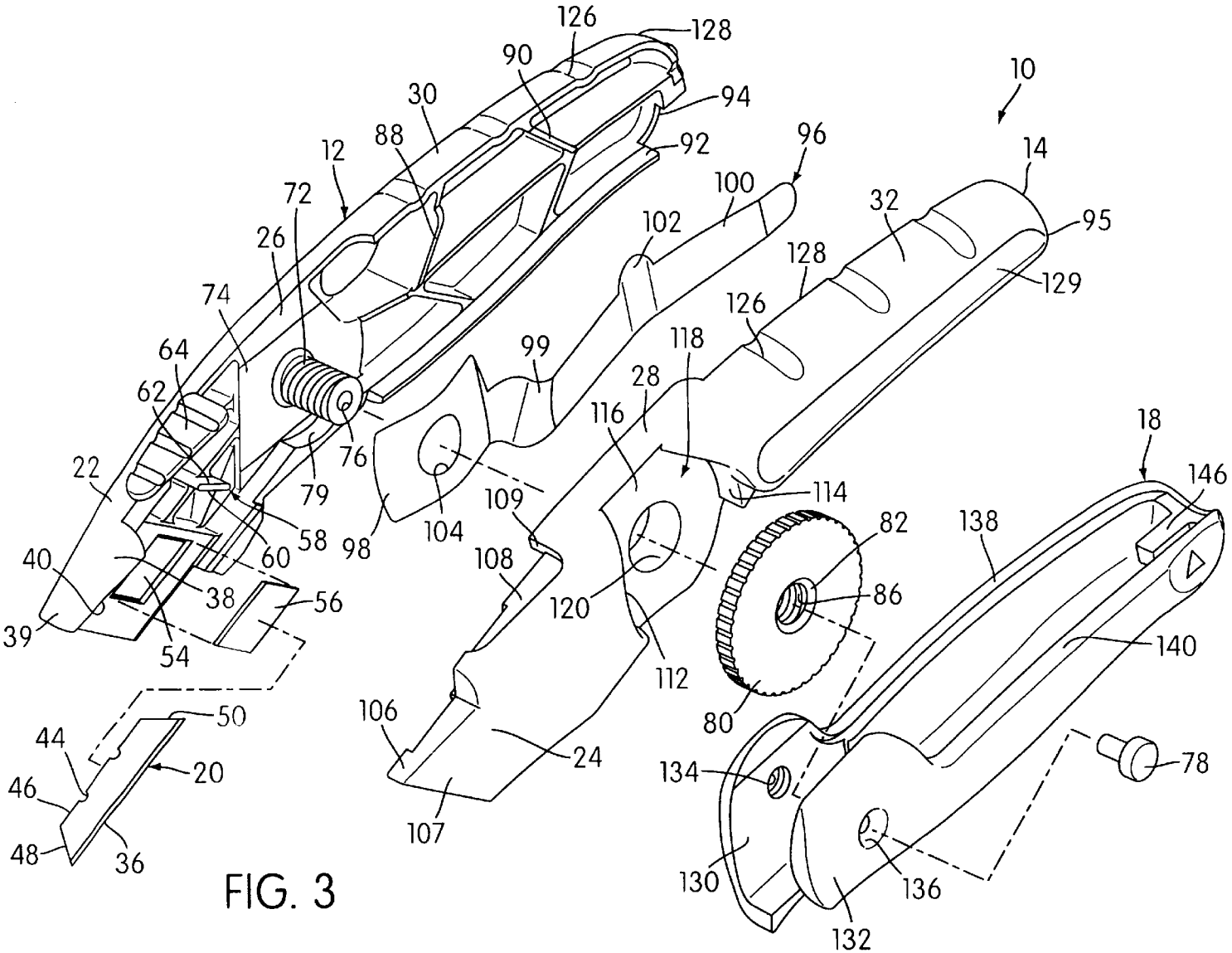
FIG. 3 is an exploded view of the cutting device shown in FIG. 1.

Referring now, more particularly to the drawings, there is shown in FIGS. 1–3 thereof a cutting device in accordance with one illustrated embodiment of the present invention. The illustrated embodiment is in the form of a utility knife, generally indicated at 10. The knife 10 is capable of having its handle sections pivoted relative to each other to access an interior cavity without fully separating the handle sections. A mechanism, which can be operated by hand, can secure the handle sections in a closed position or permit the handle sections to move to the open position. Also, the knife 10 can include a gripping member that allows for easy gripping of the knife. It should be understood that the knife 10 is one illustrated embodiment incorporating principles of the invention, and illustrating how one embodiment can be constructed and function.

As seen in FIGS. 1–3, the knife 10 can include first and second relatively rigid handles, generally indicated at 12 and 14, respectively. The knife 10 further includes a fastener assembly, generally indicated at 16, which couples the first and second handles 12, 14 to one another. The first and second handles 12, 14 can pivot relative to one another between an open, inoperative position (FIG. 6) and a closed, operative position (FIG. 1) about the fastener assembly 16. The fastener assembly 16 can also secure a gripping element 18, such as an elastomeric member, in abutting relation with respect to the first and second handles 12, 14.

A knife blade 20 (shown in phantom in FIG. 2) is removably and securely positioned between the first and second handles 12, 14 when the first and second handles 12, 14 are moved into their closed, operative position and secured therein by the fastening assembly 16.

The first and second handles 12, 14 may be made from various sturdy materials that permit the user use the cutting device 10 as intended. Specifically, the first and second handles 12, 14 can be made from metal, for example, by molding. The handles 12 and 14 can also be formed from other materials, such as plastic, for example, by molding. Additionally, each handle 12 and 14 can be made as a composite or, as illustrated, be integrally formed as a single, unitary element.

The handles 12, 14 can also have complementary configurations with one another. For example, in the illustrated embodiment, the first and second handles 12, 14 constitute mating halves of the knife 10. Even though the illustrated embodiment does not show that both handles 12 and 14 are perfect halves, they generally form two sides or halves that mate with each other. The first and second handles 12, 14 each have a front end or front blade retaining portion 22, 24, an intermediate marginal portion 26, 28 and a rear gripping portion 30, 32, respectively.

Figure 6:
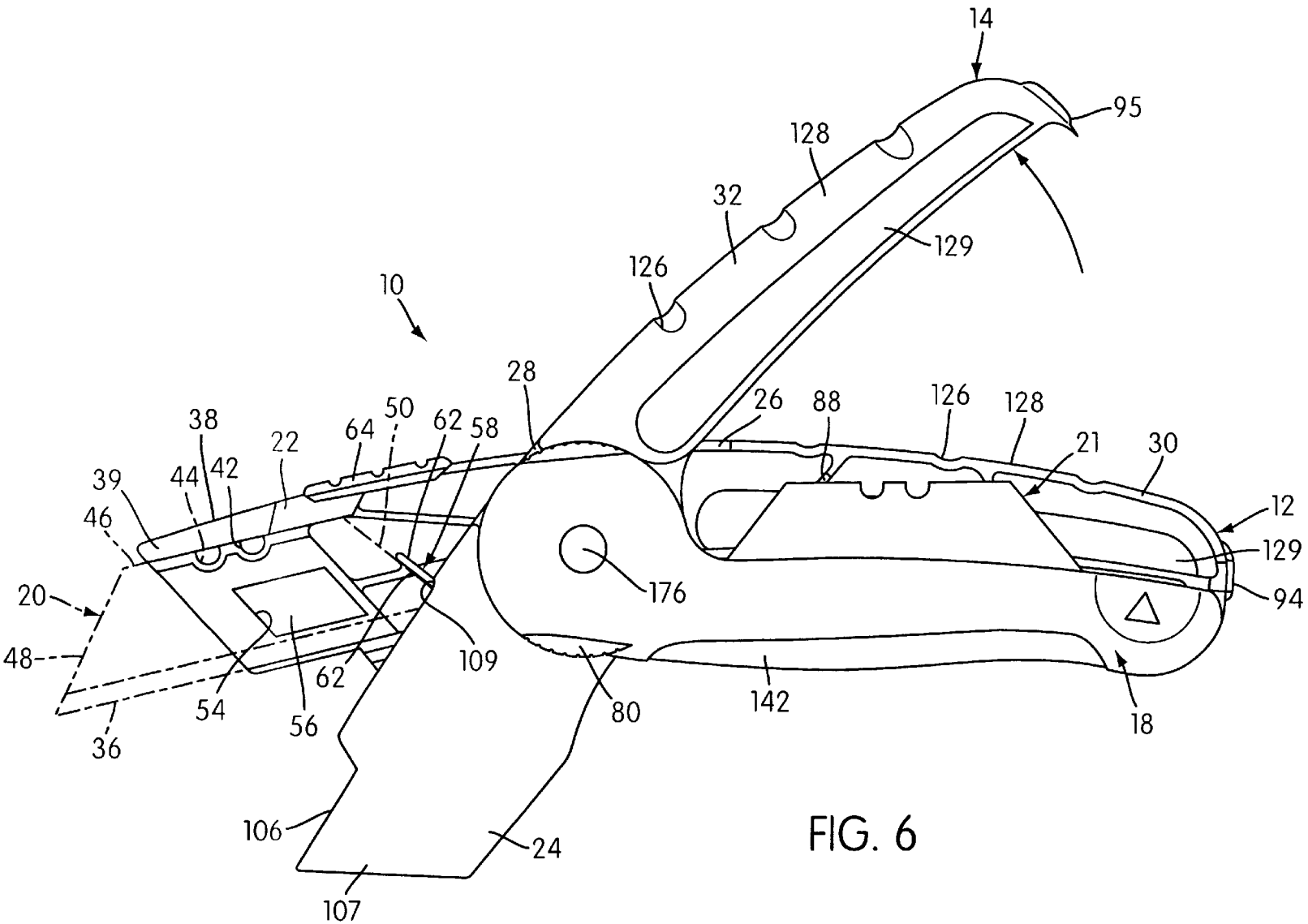
FIG. 6 is a side view of the cutting device shown in FIG. 1, but showing the cutting device in the open, inoperative position.

As seen in FIGS. 3 and 6, the front blade retaining portions 22, 24 of the first and second handles 12, 14, respectively, cooperate to form a front tip or nose portion 34 from which the knife blade 20 projects outwardly and forwardly to present a cutting edge 36 thereof. A projecting flange 38 can be formed at a forward portion 39 of the front blade retaining portion 22 and inwardly extends from the front blade retaining portion 22 to define an upper blade supporting surface 40 on an underside thereof. Spaced blade engaging protrusions 42 downwardly extend from the upper blade supporting surface 40.

As seen in FIG. 6, the knife blade 20 (shown in phantom in FIG. 6) can have a generally trapezoidal shape with the cutting edge 36 along a large straight side thereof opposite a short straight side 46. The ends of the knife blade 20 can be defined by angular edges 48, 50. Notches 44 can be formed in the short straight side 46 of the knife blade and can be configured to mate with a complementary blade engaging protrusion 42.

Figure 5:
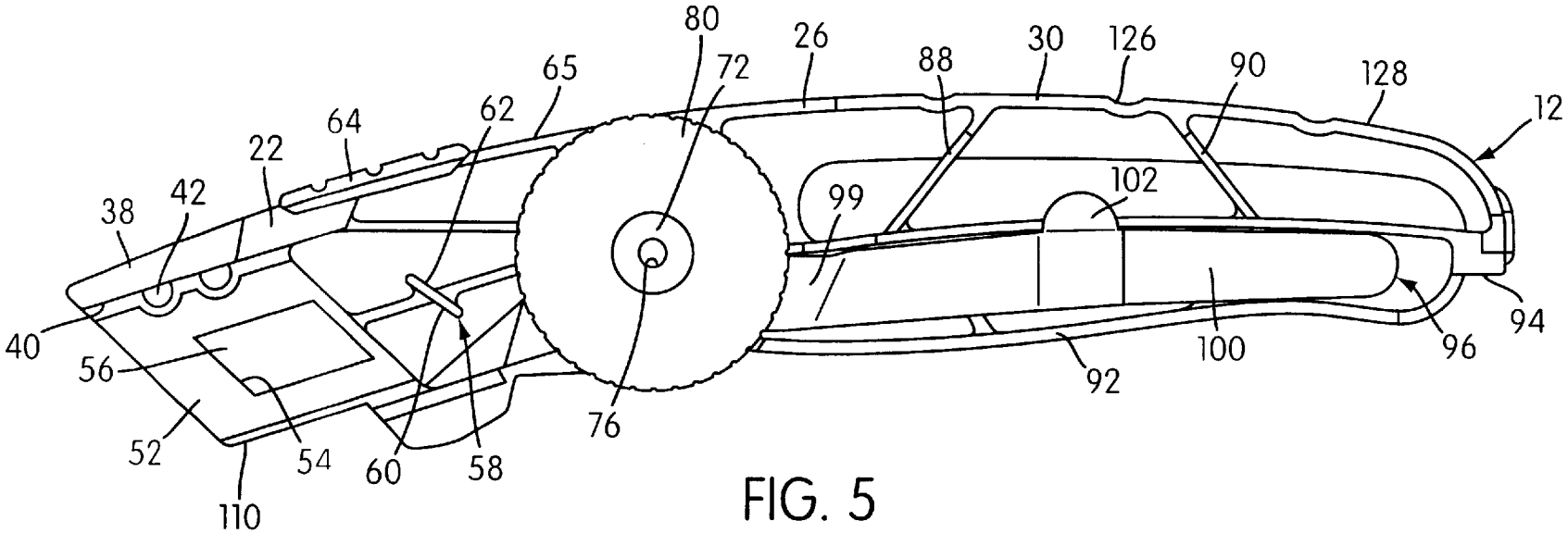
FIG. 5 is a side view of one of the handles of the cutting device shown in FIG. 2.

As seen in FIG. 5, a side blade supporting surface 52 extends downwardly from the upper blade supporting surface 40. A recessed magnet-carrying portion 54 can be formed in the side blade supporting surface 52 and be configured to carry a magnet 56. The magnet 56 can slidably support the knife blade 20 when the knife blade 20 is operatively secured between the first and second handles 12, 14.

In the illustrated embodiment, the recessed magnet carrying portion 54 and the magnet 56 can have complementary configurations, as best shown in FIG. 3. The magnet 56 may be adhesively secured within the recessed magnet-carrying portion 54 or, alternatively, the magnet 56 may be bonded or secured within the recessed magnet-carrying portion 54 in any appropriate manner.

As seen in FIG. 5, the front blade-retaining portion 22 can further include an inwardly extending stop member 58. The stop member 58 can have an angular stop surface 60 configured to abut the angular edge 50 of the knife blade 20. The angular stop surface 60 and the angular edge 50 can have substantially complementary planar configurations.

Defined on the opposite side of the stop member 58 is an angular stop surface 62. The angular stop surface 62 is configured to abut the front blade retaining portion 24 of the second handle 14 to help stop relative pivotal movement between the first and second handles 12, 14 with respect to one another, as will be described in greater detail below.

A gripping element in the form of a thumb grip 64 integrally, inwardly extends from an upper surface 65 of the front blade-retaining portion 22. The thumb grip 64 has a generally triangular configuration (when viewed from above in FIG. 1) and may have a series of grooves formed therein for improving gripping when the first and second handles 12, 14 are manually engaged by a user.

Figure 4:
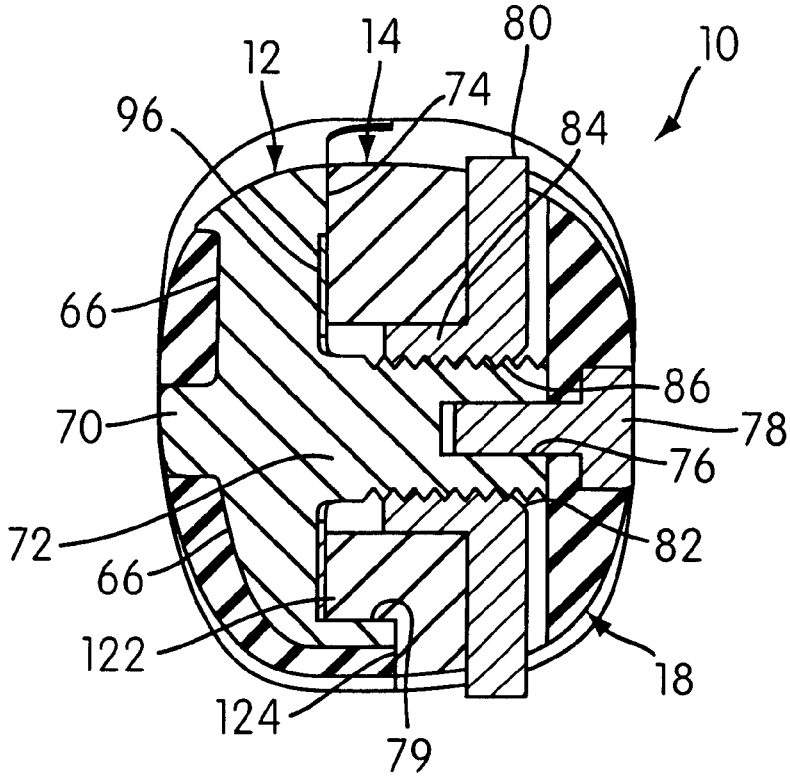
FIG. 4 is a cross-sectional view taken along the line 4—4 of FIG. 2 with the securing and releasing mechanism in the secured position.

Extending rearwardly from the thumb grip 64 is the intermediate marginal portion 26 of the first handle 12. As seen in FIG. 4 (and in FIG. 12 with respect to cutting device 210), the intermediate marginal portion 26 has an exterior gripping member engaging surface 66 that extends rearwardly to the rear gripping portion 30. An outwardly extending projection 70 extends from the exterior surface 66 for engaging with the gripping member 18.

As seen in FIGS. 3 and 4, a threaded boss 72 extends inwardly from a generally flat, interior side surface 74, which is disposed on the opposite side of the first handle 12 as the outwardly extending projection 70. The threaded boss 72 has a hollow configuration, represented by a bore 76 (FIG. 3). The bore 76 is configured to receive fastener 78 such as a rivet or drive pin therein. As seen in FIG. 4, when the bore 76 of the threaded boss 72 receives the fastener 78 in a secure fashion, the first and second handles 12, 14 are fixedly and permanently coupled to one another. The boss 72, the bore 76, and the fastener 78 cooperate to form a pivot mechanism about which the first and second handles 12, 14 pivot relative to one another.

Figure 22:
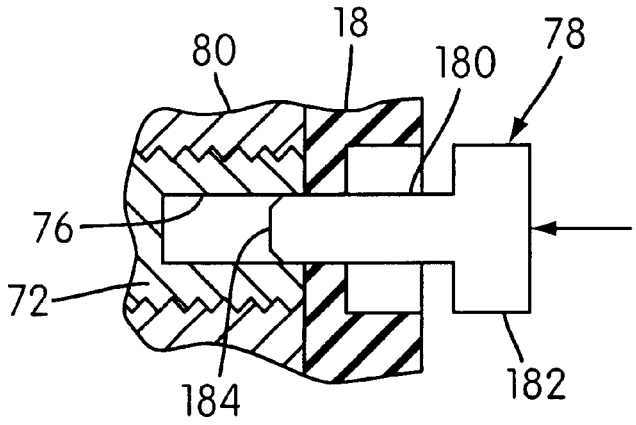
FIG. 22 illustrates a drive pin in accordance with the first embodiment of the present invention as it begins to engage the threaded stud.
Figure 23:
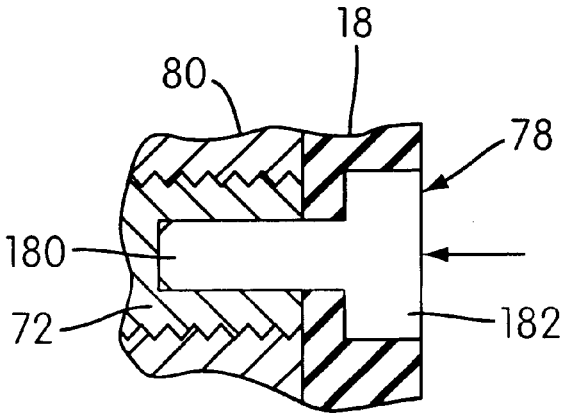
FIG. 23 illustrates the drive pin of FIG. 22 after full frictional engagement with the threaded stud.

If a rivet or drive pin 78 is used to secure the two handles 12 and 14 together, one method of using the drive pin 78 is illustrated in FIGS. 22 and 23. The drive pin 78 has a fastening end 180 and a head 182. Also, the tip 184 of the fastening end 180 can be tapered to make the fastening end 180 easier to insert. In FIG. 22, the drive pin 78 is being inserted into the bore 76 of threaded boss 72. The end 180 of the drive pin 78 can have a slightly smaller diameter of the bore 76 to permit the end 180 to enter the bore 76 while creating a secure frictional engagement between the drive pin 78 and the bore 76. The engagement of the end 180 and the bore 76 can create an interference fit or a force fit. Thus, the drive pin 78 is driven into the bore 76 under force to create a substantially rigid and permanent connection when the drive pin 78 is driven fully into the bore 76 as seen in FIG. 23. It should be understood that other fasteners 78 could be used instead of the one illustrated in FIGS. 22–24. For example, the fastener can be similar to drive pin 78 but formed such that the fastening end 180 expands within bore 76 to frictionally engage the fastener within bore 76. Additionally, threaded fasteners could be used with mating threaded openings.

Figure 11:
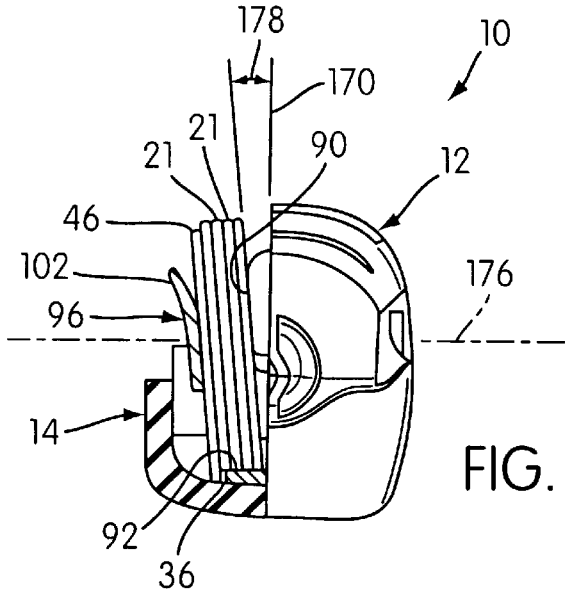
FIG. 11 is partial rear view in partial section of the cutting device illustrated in FIG. 1.

As seen in FIG. 3, a bottom flange 92 longitudinally extends inwardly from the intermediate marginal and rear gripping portions 26, 30, adjacent a rear end 94, 95 of the first handle 12. At its forwardmost end, the flange 92 defines a recessed journaling portion 79 of generally arcuate configuration that receives handle 14 as seen in FIG. 4. Flange 92 and is configured to support the cutting edges 36 of a number of replacement knife blades 20 as seen in FIG. 11.

Figure 7:
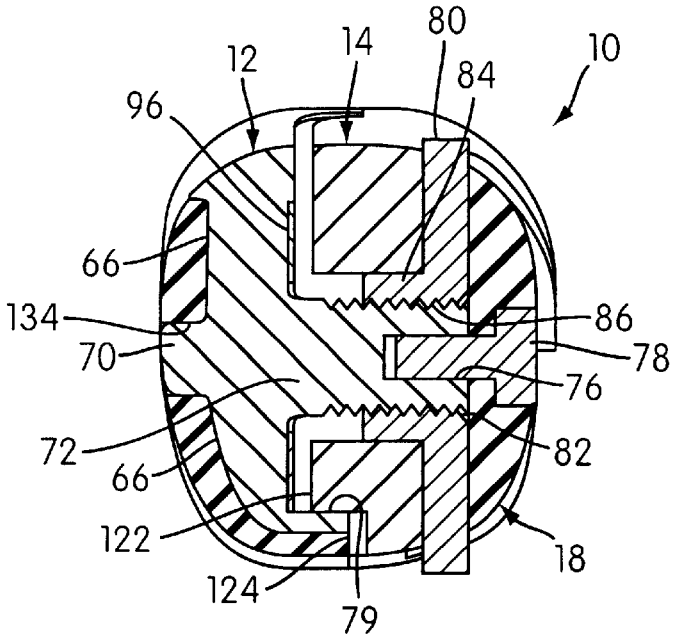
FIG. 7 is a cross-sectional view similar to FIG. 4, but illustrating the securing and releasing mechanism in the released position.
Figure 8:
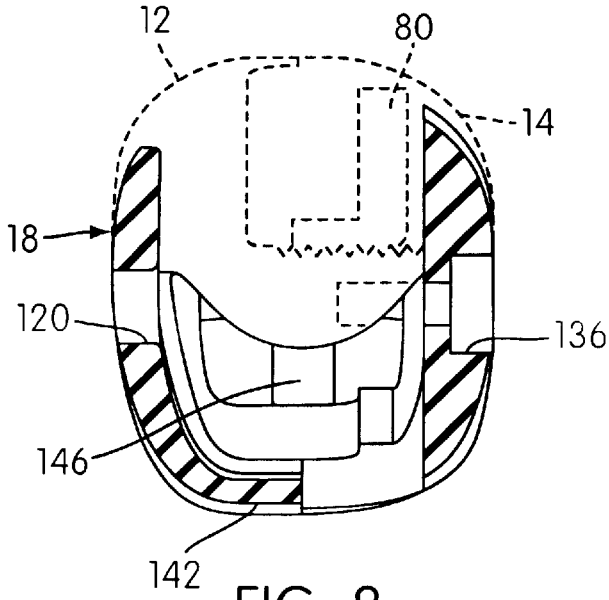
FIG. 8 is a cross-sectional view similar to FIG. 4, but illustrating only the gripping member, with the handles and the knob illustrated in dashed lines.

In the illustrated embodiment, a manually engageable securing member, such as a knob or an annular dial 80, is coupled to the fastener assembly 16. As seen in FIGS. 4 and 7, the annular dial 80 can be moved between a secure position and a release position in an axial direction along the threaded boss 72. As seen in FIGS. 1 and 4, the dial 80 extends out from within the handles 12 and 14 so that it can be accessed by the user to move the dial 80 between the secure and release positions. To aid in gripping the dial 80, the dial 80 is knurled on its circumference.

The annular dial 80 has a beveled portion 82 formed in the center thereof to receive the fastener 78 and an inwardly extending flange 84. The beveled portion 82 and the inwardly extending flange 84 cooperate to define an elongated, threaded opening 86. The threaded opening 86 is configured to receive the threaded boss 72 in threadedly engaging relation so that the annular dial 80 can move between its secure position (FIG. 4) and its release position (FIG. 7) in an axial direction along the threaded boss 72.

In the illustrated embodiment, the rear gripping portion 26 of the first handle 12 includes inwardly extending angular surfaces 88, 90 positioned in converging relation with respect to one another (FIGS. 3 and 5). As seen in FIG. 11, the angular surfaces 88, 90 are inclined with respect to a plane 170, which is substantially perpendicular to the pivot axis 176, such that the short straight side 46 of the knife blade 20 extends more inwardly than the cutting edge 36. This inclination of the angular surfaces 88, 90 facilitates storage and retrieval of replacement blades 21 (FIGS. 6 and 11), as will be described in greater detail below. The angle 178 of the inclination of the surfaces 88 and 90 from the plane 170 can be any appropriate angle to incline the replacement blades 21 sufficiently to make removal of the blades 21 easier.

As seen in FIG. 3, the front blade retaining portion 24 of the second handle 14 includes a projection receiving portion 106 which is configured to receive the inwardly projecting flange 38 at a forward portion thereof 107. A recessed portion (not shown) may downwardly extend from the projection receiving portion 106 so as to be positioned adjacent the blade engaging protrusions 42 to help operatively secure the knife blade 20 between the first and second handles 12, 14 when the first and second handles 12, 14 are moved into their closed, operative position.

As illustrated in FIG. 3, a recessed portion 108 is formed in the front blade retaining portion 24 and is configured to receive the thumb grip 64 when the first and second handles 12, 14 are secured in their closed, operative position. An inwardly projecting stop flange 109 integrally extends from the recessed portion 108. The inwardly projecting stop flange 109 is located rearwardly of and adjacent to the thumb grip 64 when the first and second handles 12, 14 are secured in their closed, operative position. The stop flange 109 is configured to abut against the angular stop surface 62 to help arrest relative pivotal movement between the first and second handles 12, 14 with respect to one another when the first and second handles 12, 14 are moved into their open, inoperative position, as seen in FIG. 6.

Figure 17:
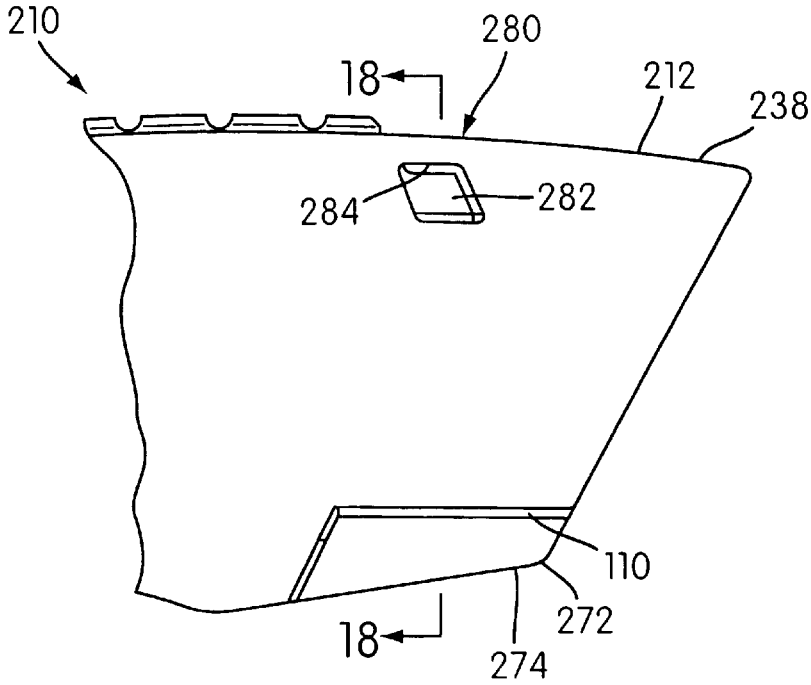
FIG. 17 is a front, partial side view of the cutting device of FIG. 12.
Figure 18:
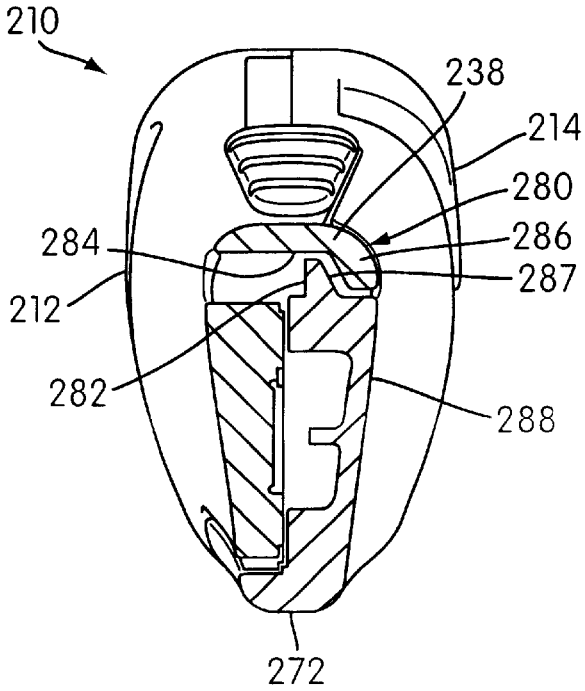
FIG. 18 is a cross-sectional view taken along line 18—18 of FIG. 17.

As seen in FIGS. 17 and 18, the front blade retaining portion 24 may further include an inwardly extending flange 172 that could be configured to abut a lower flange receiving surface 110 (also seen in FIG. 5) of the front blade retaining portion 22 in cooperating relation. The inwardly extending flange 172 and the lower flange receiving surface 110 could then support a portion of the cutting edge 36, i.e., the portion of the cutting edge 36 that does not extend forwardly and outwardly from the front nose portion 34 when the blade 20 is operatively secured between the first and second handles 12, 14.

As seen in FIG. 3, the intermediate marginal portion 28 of the second handle 14 has a generally annular configuration in order to receive the annular dial 80 therein. The intermediate marginal portion 28 includes outer, oppositely facing arcuate walls 112, 114 and an outer planar surface 116 that extends between the arcuate walls 112, 114. The outer planar surface 116 is configured to abut an inner surface of the annular dial 80. The arcuate walls 112, 114 together with the outer planar surface 116 define a dial receiving space 118. The annular dial 80 can be moved within the dial receiving space 118 between its secure position (FIG. 4) and its release position (FIG. 7), with the fastener 78 helping to define the outward extent of the annular dial's release position in which the annular dial 80 is substantially flush with an exterior surface of the intermediate marginal portion 28 of the second handle 14.

A central opening 120 of the second handle 14 is defined in the outer planar surface 116 and is configured to allow the threaded boss 72 to pass therethrough so that the threaded boss 72 may threadedly engage the threaded opening 86 of the annular dial 80.

As best shown in FIG. 4, an annular projecting flange 122 extends inwardly from an interior surface 124 of the second handle 14 to be received in rotating relation with the recessed journaling portion 79. While FIG. 4 illustrates a cross-sectional view of the annular flange portion 122 and its recessed journaling portion 79 of the first handle 12. The annular flange portion 122 is circular and the recessed journaling portion 79 receives only a portion thereof while the annular flange portion 122 rotates with the second handle 14 relative to the recessed journaling portion 79 of the first handle 12. The annular flange portion 122 completely surrounds the associated central opening 120 and the threaded boss 72 when the first and second handles 12, 14 are secured in their closed, operative position.

The rear gripping portion 32 of the second handle 14 is substantially thinner, i.e., the rear gripping portion 32 is smaller in vertical height, than the rear gripping portion 30 of the first handle 12. The rear gripping portions 30, 32 constitute a handle structure, which includes a series of grooves 126 along an upper arcuate surface 128 thereof. Each rear gripping portion 30, 32 may have a recessed portion 129 formed therein to provide additional strength and rigidity and/or aesthetic improvements to the rear gripping portions 30, 32.

The gripping member 18 can be formed from any appropriate material that enhances the gripping ability of the knife 10. For example, gripping member 18 can be formed from an elastomeric material, such as, rubber, either natural or man-made, or from other material that is easily gripped, such as a soft, flexible material. The gripping member 18 has a generally U-shaped configuration with its open end facing upwardly toward the first and second handles 12, 14. It is contemplated that the gripping member may also be partially formed from plastic, but have an outer elastomeric gripping layer for engaging the user's hand.

As best seen in FIGS. 3 and 7, the gripping member 18 includes enlarged portions 130, 132, each defining an opening 134, 136, respectively, therein. Opening 134 is sized to receive projection 70, while opening 136 is sized to receive projection 78. The enlarged portions 130, 132 have complementary configurations with the exterior surface 66 of the first handle 12 and the outer planar surface 116 of second handle 14, respectively. The enlarged portion 132 substantially covers the annular dial 80 but does not completely cover the dial 80, such that the annular dial 80 can be engageable by a user, i.e., using their thumb or finger, to rotate the annular dial 80. Extending rearwardly from the enlarged portions 130, 132 are upwardly facing handle engaging surfaces 138, 140, respectively.

The gripping member 18 defines a bottom surface 142 positioned between two upstanding side portions 174 and 176. The gripping member 18 and the first and second handles 12, 14 together are configured to provide a secure, comfortable grip for the user.

Figure 10:
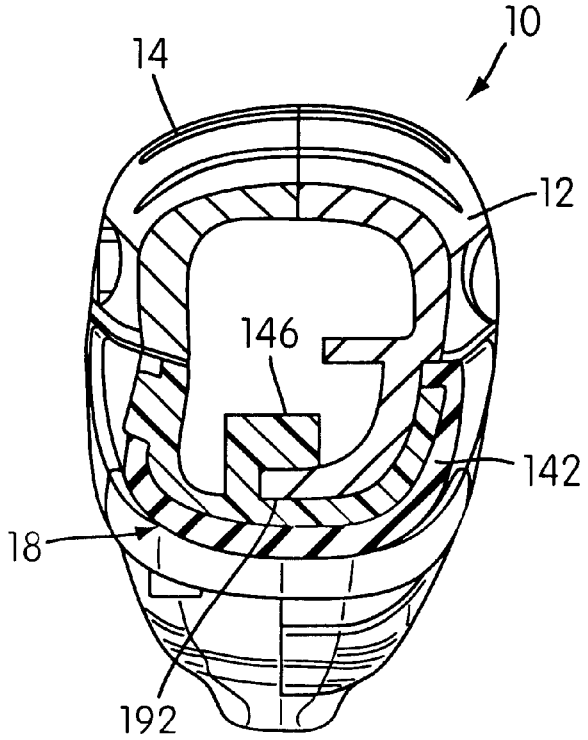
FIG. 10 is a cross-sectional view taken along the line 10—10 of FIG. 2.

As seen in FIGS. 2 and 10, the lower part 142 of the gripping member 18 can be of solid, one-piece construction to surround the bottom surfaces of the handles 12 and 14. The exterior surface of the gripping member 18 can extend between the handle engaging surfaces 138, 140 to define the bottom of the manually-engageable gripping surface of the cutting device 10.

As shown in FIGS. 3 and 10, the gripping member 18 has a forwardly protruding member 146 located at the rear of the gripping member 18. The protruding member 146 is configured to engage the upper surface of the flange 92 so as to aid in retaining the gripping member 18 in secured relation with respect to the first handle 12.

As seen in FIGS. 4 and 11, the gripping member 18 is secured to the first and second handles 12, 14. For example, the outwardly extending projection 70 of handle 12 may extend through the opening 134 in the enlarged portion 130, the underside surface of the forward protrusion 146 at the rear of the gripping member 18 may engage the upper side surface of the flange 92 of the first handle 12, and the fastener 78 may extend through the opening 136 in the enlarged portion 132 and extend into the bore 76 formed in the threaded boss 72. When the gripping member 18 is secured to the first and second handles 12, 14, the handle engaging surface 138 of the gripping member 18 is received in the exterior gripping member receiving surface 66 of the first handle 12 and the handle engaging surface 140 of the gripping member abuts bottom of the rear gripping portion 32 of the second handle 14.

Figure 9:
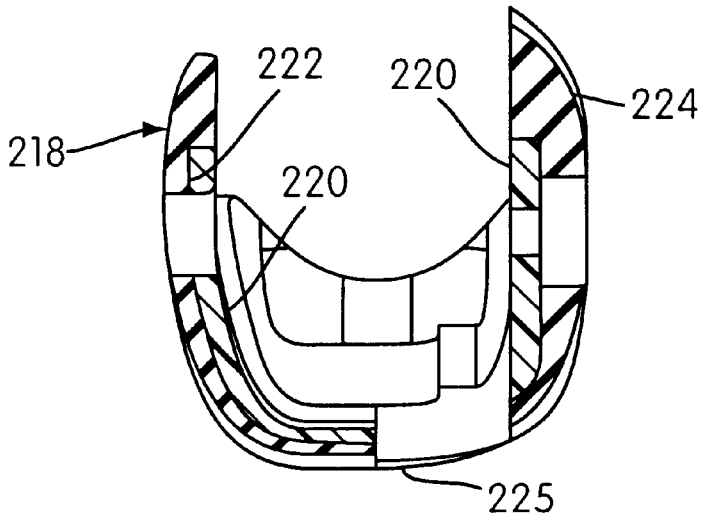
FIG. 9 is similar to FIG. 8, but illustrates an additional embodiment of the gripping member in which the gripping member has a supporting layer beneath a gripping surface.

Another embodiment of the gripping member is illustrated in FIG. 9. Gripping element 218, as seen in FIG. 9, is substantially identical to gripping member 18 except for the presence of an interior supporting layer 220. Layer 220 is fit within the same dimensions of gripping member 18, since it fits within a recess 222 of the outer surface 224 of the gripping member 218. Whereas the outer surface 224 can be made of a gripping material similar to gripping member 18, such as an elastomeric material, the layer 220 is preferably made of a more rigid layer, specifically plastic, to provide structural support to the gripping member 218 and to increase the structural strength of the gripping member 218 especially in the areas of the gripping member 218 that form the bottom of the cutting device in which it is employed, such as bottom section 225.

As seen in FIG. 3, a biasing member 96, such as a spring, can be included between the handles 12 and 14. The biasing member 96 has a front portion 98 and a rear portion 100. At the transition between the front portion 98 and the rear portion 100, a transverse bend 99 orients the front portion 98 at an obtuse angle with respect to the rear portion 100.

The front portion 98 of the biasing member 96 is slightly flexed into an arcuate configuration such that the front portion 98 biases the first and second handles 12, 14 away from one another when the annular dial 80 is in the release position thereof. In the closed, operative position of the first and second handles 12, 14, the front portion 98 of the biasing member 96 is biased into a generally flat configuration between the first and second handles 12, 14.

The front portion 98 of the biasing member 96 forms a circular opening 104 therein that is configured to receive the threaded boss 72 therethrough. The opening 104 positions the biasing member 96 in adjacent relation to the first handle 12 such that the rear portion 100 of the biasing member 96 can be supported on the flange 92.

The rear portion 100 of the biasing member 96 is configured to facilitate replacement blade storage between the first and second handles 12, 14 by biasing the replacement blades 21 against the inwardly extending angular surfaces 88, 90, as seen in FIG. 17. The rear portion 100 of the biasing member 96 includes a tab 102, which upwardly extends therefrom.

In the illustrated embodiment, the tab 102 is bent inwardly, toward the second handle 14 (as shown in FIG. 11), which may facilitate "loading" of replacement blades 21 in the cutting device 10. For example, a user may easily place the cutting edge of a replacement blade 21 between the bent tab 102 and the first handle 12 and then push the blade 20 toward the flange 92 until the cutting edge thereof engages the flange 92. Thus, the replacement blade 21 can easily slide between the bent tab 102 and the first handle 12 so that the replacement blade 21 can be secured by the rear portion 100 of the biasing member 96.

Other configurations for supporting replacement blades 21 can also be employed. For example, the first and second handles 12, 14 may form numerous cavities and inwardly extending protrusions not described herein, such as, to support a blade carrier configured to carry a knife blade 20 between the first and the second members 12, 14 so that the length of the cutting edge extending outwardly and forwardly of the first and second members 12, 14 is adjustable. A suitable blade carrier is described in U.S. Pat. No. 5,301,428, the entirety of which is hereby incorporated into the present application by reference Since the replacement blades 21 are identical to the knife blade 20 in construction and operation, the above description relating to the knife blade 20 will suffice for both.

Operation

The operation of the cutting device 10 will be described as follows and presents one example of the operation of the illustrated embodiment of the invention.

The first and second handles 12, 14 can be moved between (1) the closed, operative position (FIG. 1) thereof in which the knife blade 20 is operatively secured between the first and second handles 12, 14 and (2) the open, inoperative position (FIG. 6) thereof in which the first and second handles 12, 14 are axially spaced from and pivoted relative to one another about the fastener assembly 16.

As seen in FIG. 4, in the closed, operative position, the first and second handles 12, 14 are secured together by the forces of the dial 80 in its tightened position on the threaded boss 72 and forcing the handle 14 against the handle 12. The handles 12 and 14 are locked together.

The handles 12, 14 may be moved into their respective, open, inoperative position by rotating the annular dial 80 about the boss 72. In the illustrated embodiment, with respect to FIGS. 2, 5 and 6, clockwise rotation of the annular dial 80 causes the annular dial 80 to engage the threaded boss 72 so that the dial 80 moves into the secure position thereof, i.e., the dial 80 tightens the first and second handles 12, 14 together and moves to the left as seen in FIG. 4. Counter-clockwise rotation of the annular dial 80 with respect to FIGS. 2, 5 and 6, causes the annular dial 80 to engage the threaded boss 72 so that the dial 80 moves into the release position thereof, i.e., the dial 80 moves the first and second handles 12, 14 away from each other as the dial 80 moves away from handles 12 and 14 and to the right as seen in FIG. 7.

The direction of rotation for the dial 80 is exemplary in nature, for example, clockwise rotation of the annular dial 80 could move the dial into the release position thereof while counter-clockwise rotation of the annular dial 80 could move the dial 80 into the secure position thereof.

In general, a user can effect rotation of the annular dial 80 in any appropriate manner by hand or with a tool. Preferably the dial 80 is constructed and arranged to permit the user to rotate the dial between the secure and the free position with his or her thumb or finger, or alternatively, with two hands.

After rotating the dial 80 in the proper direction, for example, clockwise to move the dial 80 into the release position thereof as seen in FIG. 7, the forward portion 98 of the biasing member 96 can bias the first and second handles 12, 14 apart from one another, as seen in FIG. 7. Then, the first and second handles can be pivoted to the open, inoperative position thereof about the threaded boss 72 to the position show in FIG. 6. In the open, inoperative position (FIG. 6), the knife blade 20 can be removed from between the first and second handles 12, 14, i.e., the notches 44 can be moved so as to disengage the blade engaging protrusions 42.

As seen in FIG. 6, the gripping member 18 remains stationary with respect to the first handle 12 during movement of the second handle 14 in the counter-clockwise direction as seen in FIG. 6. This is due to the securing of the gripping member 18 to the first handle by the protruding member 146 as seen in FIG. 10 and by the attachment of the gripping member 18 to the projection 70 of the first handle as seen in FIG. 4.

As seen in FIG. 6, the stop flange 109 of the second handle 14 and the angular stop surface 62 of the first handle 12 limit relative pivotal movement between the first and second handles 12, 14 to help reduce possible damage that may be caused by opening the first and second handles 12, 14 too far apart from one another.

If there is no knife blade 20 positioned in the front nose portion 34 of the cutting device 10, a knife blade 20 may be positioned within the front nose portion 34 when the first and second handles 12, 14 are pivoted into their open, inoperative position. To position the blade 20, the notches 44 in the blade 20 are moved until the blade engaging protrusions 42 of the first handle 12 fully engage the notches 44. The magnet 56 will help secure the blade 20 to the first handle 12.

Then, the user may pivot the second handle 14 around the pivot member 72 and about the pivot axis 176 until the first and second handles 12, 14 move into their closed, operative position as seen in FIG. 1. The annular dial 80 may then be rotated in the proper direction, for example, counter-clockwise to move the manually engageable fastener into the secure position (FIG. 4) thereof, so that the first and second handles can operatively secure the knife blade 20 therebetween.

FIGS. 12–21

FIGS. 12–21 illustrate yet another embodiment of the invention in the form of cutting device 210. Cutting device 210 is substantially identical to cutting device 10 set forth above except for the inclusion of an additional rear locking mechanism 270, an additional front locking mechanism 280, a washer 350, and a fulcrum 290 to force the front of the handles 212 and 214 adjacent the knife blade 20 to close before the rear of the handles 212 and 214. Accordingly, only those additional features of cutting device 210 will be discussed in detail. Additionally, like reference numerals represent similar parts throughout the several views of the drawings.

Figure 12:
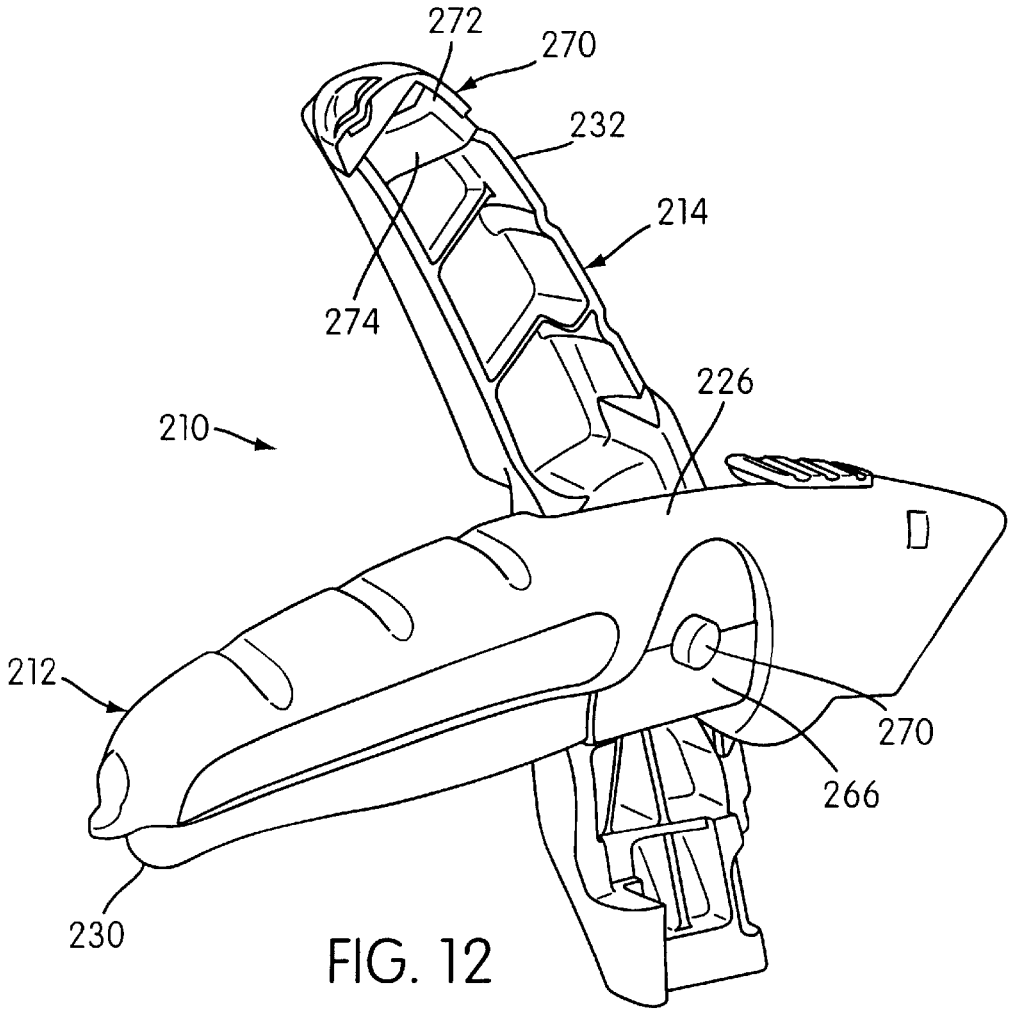
FIG. 12 is a rear perspective view of a cutting device in accordance with an additional embodiment of the present invention in the open position.
Figure 13:
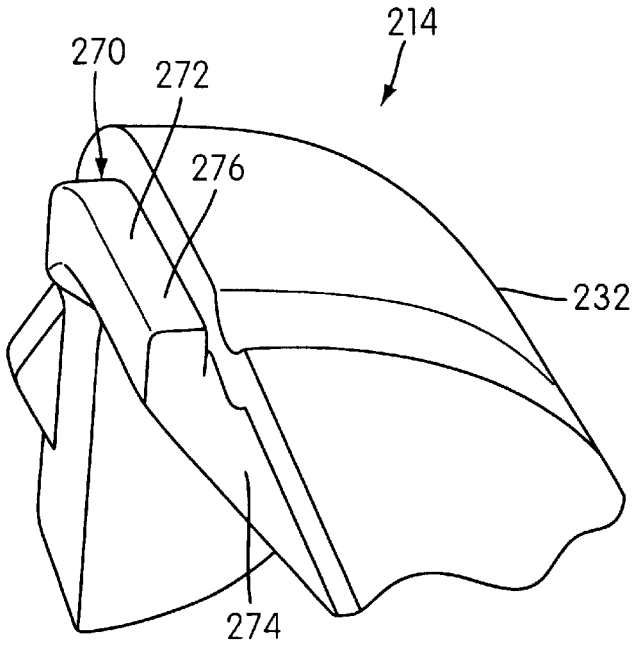
FIG. 13 is a perspective view of the rear locking mechanism of the cutting device of FIG. 12.
Figure 14:
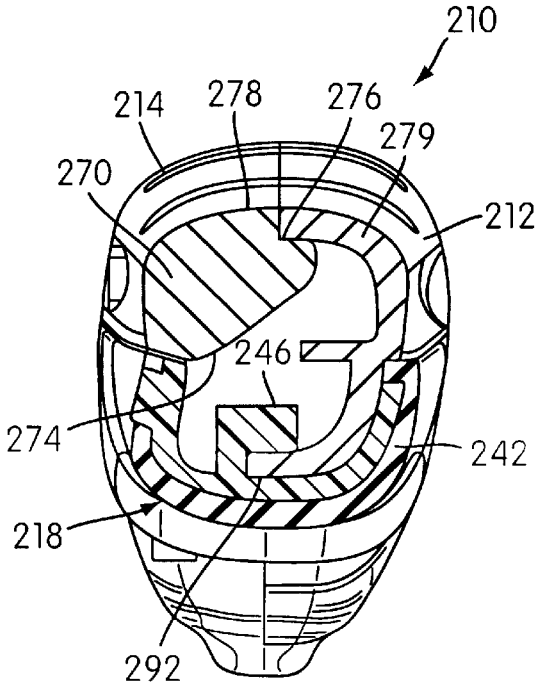
FIG. 14 is a cross-sectional view similar to FIG. 10, but illustration the rear locking mechanism of the cutting device of FIG. 12.
Figure 15:
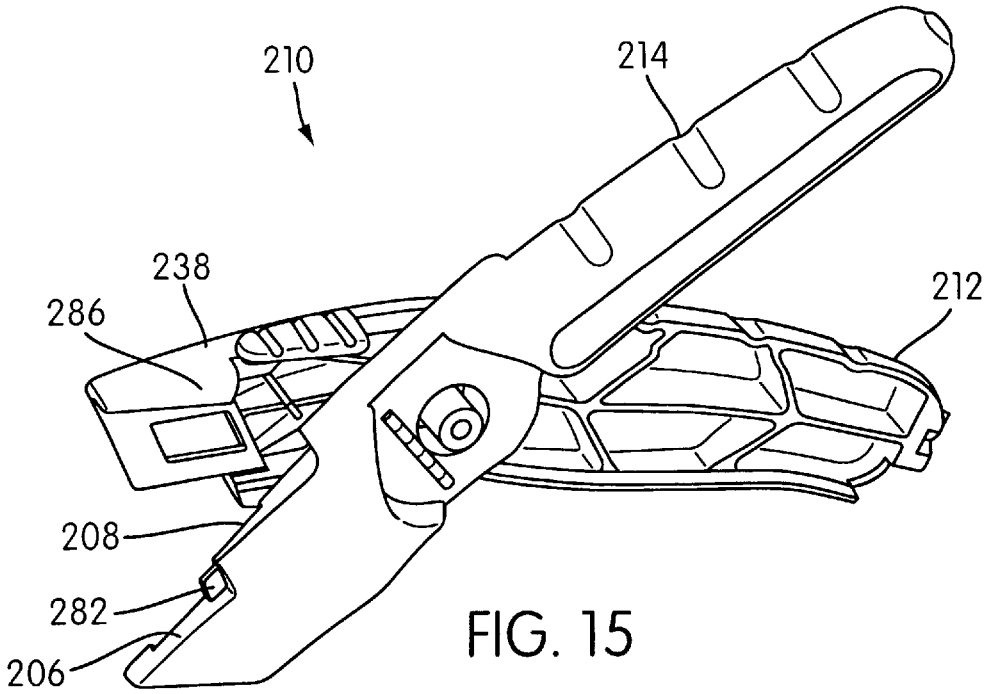
FIG. 15 is a front perspective view of the cutting device of FIG. 12 in the open position.
Figure 16:
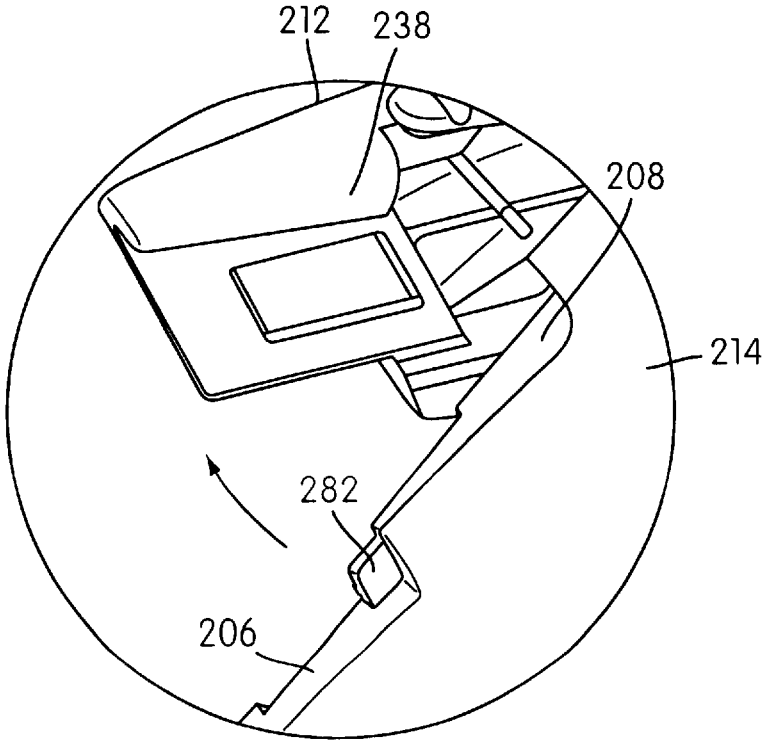
FIG. 16 is an enlargement of the front locking mechanism illustrated in FIG. 15.

As seen in FIGS. 12–14, cutting device 210 includes a rear locking mechanism 270 to further secure the gripping portions 230 and 232 to each other when the cutting device 210 is in the closed, operative position. Locking mechanism 270 is a lug with a projection 272 and a thickened area 274. The projection 272 extends from the handle 214 toward the handle 212. The top surface 276 of the projection 272 is spaced lower than the outer surface 278 of the gripping portion 232 a distance that is substantially equal to the width of the wall 279 of the opposite handle 212, adjacent the projection 272. As seen in FIG. 14, when the cutting device 210 is in the closed, operative position, the top surface 276 of projection 272 supports the wall 279 of the handle 212. Thus, when external pressure is applied to the wall 279 of handle 212, the projection 272 of locking mechanism 270 will support the wall 279 and prevent the wall 279 from moving or deforming inwardly.

FIGS. 15–18 illustrate the front locking mechanism 280, which provides additional structural support to the handles 212 and 214 during use of the cutting device 210. Locking mechanism 280 includes a lug 282 formed on the forward end of handle 214 and a mating slot 284 formed on the forward end of handle 212. Lug 282 extends from recessed portion 208 and upwardly from recessed portion 206. Slot 284 is located beneath projecting flange 238 formed in the front of handle 212 above the area receiving blade 20 and forms a retaining wall 286 on the side 287 of the lug 282 facing the exterior surface 288 of the handle 214.

As seen in FIG. 18, when the cutting device 210 is in the closed, operative position, the retaining wall 286 maintains the lug 282 and the handle 214 to which it is attached from being separated from the other handle 12 during use. In other words, the locking mechanism 280 prohibits the handles 212 and 214 from spreading in the area of the where the handles 212 and 214 hold the knife blade 20. Thus, when external pressure is applied onto the blade 20 during use and urges the handles 212 and 214 toward separation, the side 287 of lug 282 contacts retaining wall 286 and further separation of the handles 212 and 214 is prevented. The locking mechanism 280 is especially useful in prohibiting separation of the handles 212 and 214 when side loads are applied to the cutting device 210.

Figure 19:
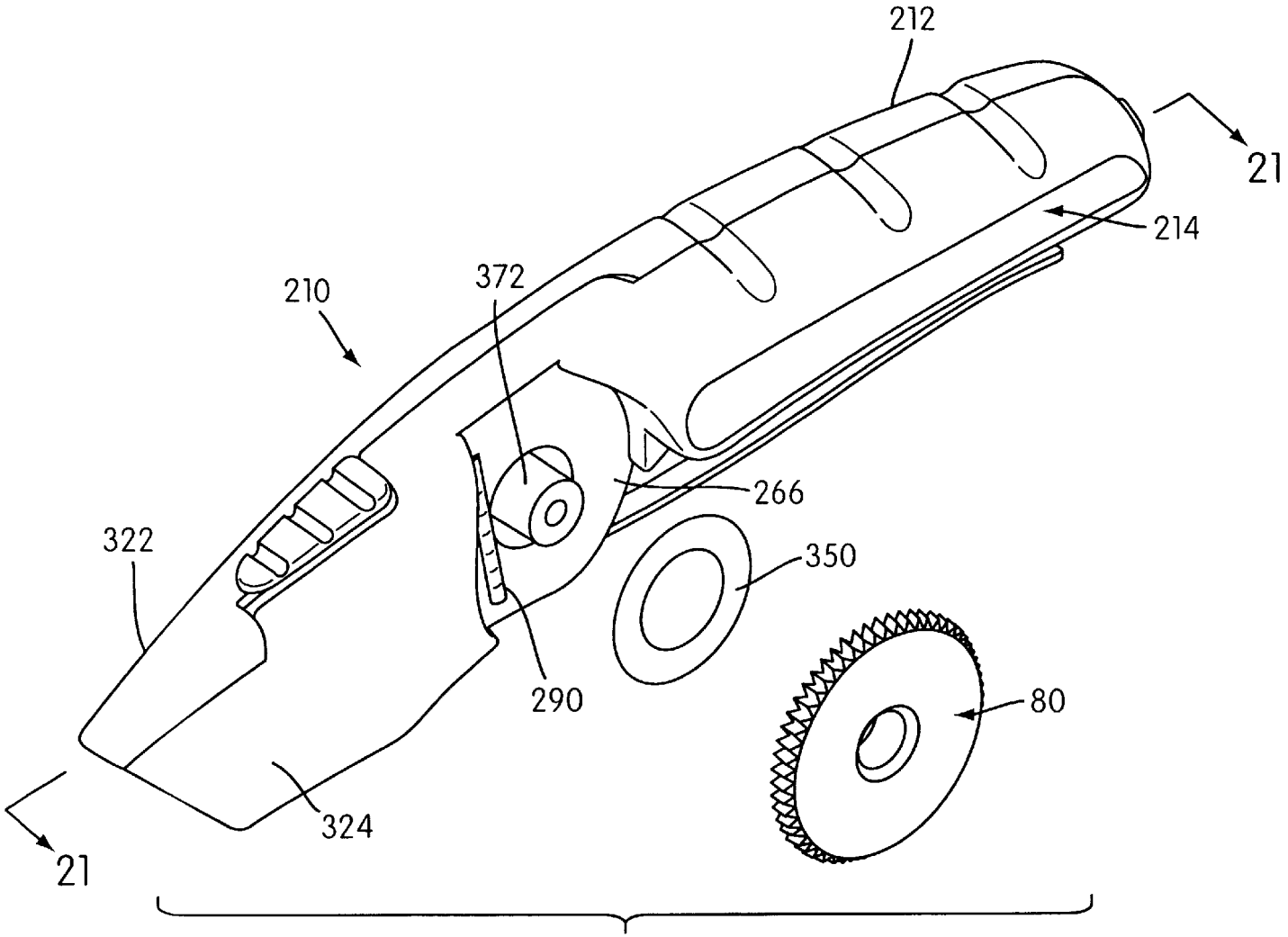
FIG. 19 is a top, perspective view of the two handles of the cutting device of FIG. 12 and with the knob and washer shown in exploded view.
Figure 20:
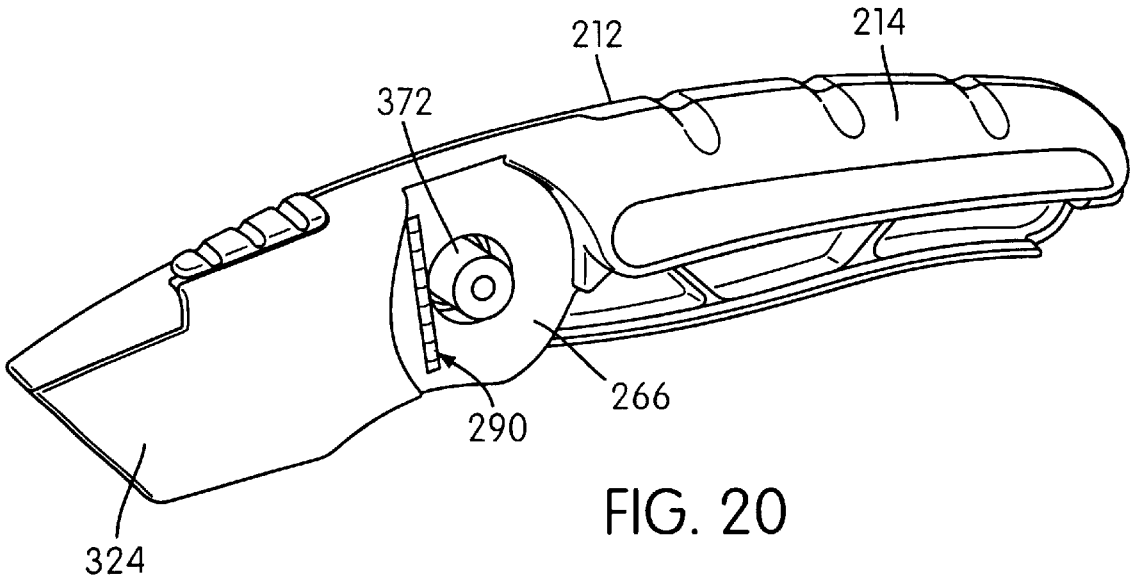
FIG. 20 is a side, perspective view of the two handles of the cutting device of FIG. 12.
Figure 21:
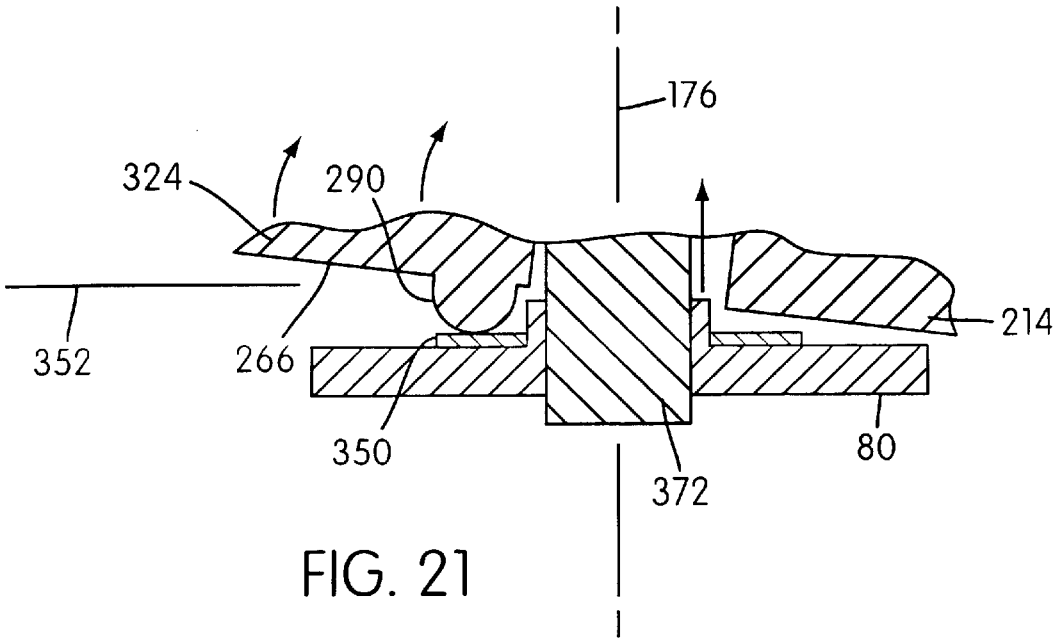
FIG. 21 is partial, cross-sectional view of the cutting device shown in FIG. 19 and illustrating the manner in which the fulcrum forces the front of the cutting device to close before the rear.

As seen in FIGS. 19–21, the fulcrum 290 is formed as a rib in the illustrated embodiment, which is positioned on the engaging surface 266 of the handle 214 where the engaging surface receives the dial or knob 80. Although illustrated as an elongated rib, the fulcrum 290 can be any shape or configuration that serves the purpose of forcing the front 322 and 324 of the handles 212 and 214, respectively, toward each other when the handles 212 and 214 of the cutting device are brought together into the closed, operative position and increases the clamping force against the knife blade 20.

As seen in FIG. 21, as the knob 80 is turned and rotated around threaded boss 372 about pivot axis 176, the knob 80 first contacts the tip of fulcrum 290 before contacting any other part of the handle 214 or its engaging surface 266. In the illustrated embodiment of FIG. 21, an optional washer 350 is employed between the knob 80 and the engaging surface 266 to facilitate untightening of the knob 80 after the knob 80 has been securely tightened against the engaging surface 266. Thus, in FIG. 21, knob 80 first contacts the tip of the fulcrum 290 through the washer 350.

As the knob 80 is further rotated and further moves along the boss 372 and the pivot axis 176, the fulcrum 290 forces the front 324 of handle 214 to move toward the other handle 212 before any other part of handle 214. This movement of the front 324 toward the other handle 212 ensures that the portions of handles 212 and 214 supporting and surrounding the knife blade 20 are the first portions of the handles 212 and 214 to contact. Thus, the knife blade 20 is captured between the handles 212 and 214 as quickly as possible. Without the use of the fulcrum 290, the entire handle 214 would be pushed to the opposite handle 212 in along a common plane 352, which would be substantially perpendicular to the pivot axis 176 since the knob 80 would contact the entire engaging surface 266 on both sides of the boss 372 at the same time.

Once the knob 80 is fully tightened around the boss 372, the pressure of the knob 80 on the fulcrum 290 permits an increased clamping force to be applied to the blade 20. Further, when the knob 80 is untightened, the fulcrum 290 facilitates swiveling the handles 212 and 214 relative to each other into the open position since the knob 80 or washer 350 is contacting only the fulcrum 290 on one side of the engaging surface 266.

While principles of the invention have been made clear in the illustrative embodiments set forth above, those skilled in the art may make various modifications to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims and the disclosure above.

What is claimed is:

1. A cutting device comprising:

first and second handles coupled to one another such that said first and second handles can pivot relative to each other about a pivot axis between an open position in which a cavity formed between said first and second handles is open and accessible to a user and a closed position in which said cavity is closed, said first and second handles being permanently fastened to each other;

a securing and releasing mechanism mounted for rotation about said pivot axis such that said securing and releasing mechanism rotates between a secure position in which said first and second handles are fixedly secured to each other and a release position in which said first and second handles are free to pivot about said pivot axis in a permanently fastened manner between said closed position and said open position, said securing and releasing mechanism being limited to the extent to which said securing and releasing mechanism can move away from said secure position so as to be unreleasably attached about said pivot axis; and a first knife blade being secured between said first and second handles.

2. A cutting device according to claim 1, wherein said first and second handles are permanently fastened to each other by a fastener extending along said pivot axis.

3. A cutting device according to claim 1, wherein said first and second handles are permanently fastened to each other by a rivet.

4. A cutting device according to claim 1, further comprising:

an integral, one-piece elastomeric member coupled to said first and second handles and overlapping said first and second handles.

5. A cutting device according to claim 1, wherein said cavity includes a first recess containing said first knife blade and a second recess containing a plurality of replacement knife blades.

6. A cutting device according to claim 1, wherein said first and second handles are biased apart from one another in the direction of said pivot axis by a biasing member.

7. A cutting device according to claim 5, wherein said cavity includes a third recess, and said first and second handles are biased apart from one another in the direction of said pivot axis by a biasing member positioned within said third recess.

8. A cutting device according to claim 1, wherein said securing and releasing mechanism includes a knob, said knob being rotatably movable along a threaded shaft positioned along said pivot axis.

9. A cutting device according to claim 8, wherein said threaded shaft protrudes from said first handle along said pivot axis.

10. A cutting device according to claim 8, wherein said knob protrudes from said second handle and is configured to be accessed and manually operated by the user when said first and second handles are in said closed position.

11. A cutting device according to claim 1, wherein each of said first and second handles includes a locking mechanism for securing said first and second handles in said closed position.

12. A cutting device according to claim 11, wherein said locking mechanism of said first handle includes a recess and said locking mechanism of said second handle includes a projection.

13. A cutting device according to claim 1, wherein said second handle includes a locking mechanism for securing said first and second handles in said closed position.

14. A cutting device according to claim 13, wherein said locking mechanism is a projection.

15. A cutting device according to claim 1, further comprising:

a fulcrum coupled to said securing and releasing mechanism permitting one end of each of said first and second handles to contact each other prior to an opposite end of each of said first and second handles as said securing and releasing mechanism rotates to said secure position.

16. A cutting device according to claim 15, wherein said fulcrum is a rib attached to said second handle.

17. A cutting device comprising:

first and second handles coupled together such that said first and second handles can pivot relative to each other about a pivot axis between an open position in which a cavity formed between said first and second handles is open and accessible to a user and a closed position in which said cavity is closed, said first handle having a first side portion and said second handle having a second side portion, which is opposite to said first side portion;

a first knife blade being secured between said first and second handles; and a gripping member having a gripping surface formed of elastomeric material and coupled to at least one of said first and second handles, said gripping surface having a first side section, a second side section, and a bottom section positioned between said first and second side sections, said first side portion of said first handle and said first side section of said gripping surface forming a first side of said cutting device, and said second side portion of said second handle and said second side section of said gripping surface forming a second side of said cutting device, which is opposite to said first side of said cutting device, and said first and second handles being formed from material different than said elastomeric material of said gripping surface.

18. A cutting device according to claim 17, wherein said gripping surface is a one-piece, integral element.

19. A cutting device according to claim 17, wherein said gripping member includes a supporting element beneath said gripping surface.

20. A cutting device according to claim 17, wherein said elastomeric material is rubber.

21. A cutting device according to claim 17, further comprising:

a securing and releasing mechanism mounted for rotation about said pivot axis such that said securing and releasing mechanism rotates between a secure position in which said first and second handles are fixedly secured to each other and a release position in which said first and second handles are free to pivot about said pivot axis in a permanently fastened manner between said closed position and said open position, said securing and releasing mechanism being limited to the extent to which said securing and releasing mechanism can move away from said secure position so as to be unreleasably attached about said pivot axis.

22. A cutting device comprising:

first and second handle members coupled to one another such that said first and second handle members can pivot relative to each other about a pivot axis between an open position in which a cavity formed between said first and second handle members is open and accessible to a user and a closed position in which said cavity is closed, said first handle member having a first side portion, an opposite second side portion, and a bottom portion positioned between said first and second side portion, said first and second side portions extending upwardly from said bottom portion to define, along with said bottom portion, a blade storage pocket of said cavity, said first side portion of said first handle member forming a first side of said cutting device, said second side portion of said first handle member and said second handle member forming a second side of said cutting device, said second handle member configured such that in said open position, said second handle member is pivoted away from said pocket to permit access to said pocket, while in said closed position, said second handle member blocks access to said pocket; and a first knife blade being secured between said first and second handle members.

23. A cutting device according to claim 22, wherein said first handle member includes a first handle element and a gripping element, with said gripping element being formed by said first and second side portions and said bottom portion.

24. A cutting device according to claim 23, wherein said gripping element is formed of elastomeric material.

25. A cutting device according to claim 32, wherein said first side portion of said first handle member includes an inner inclined surface which is inclined relative to said plane.

26. A cutting device according to claim 22, further comprising:

a plurality of knife blades positioned within said pocket.

27. A cutting device according to claim 22, wherein at least one of said plurality of knife blades extends outside said pocket and above said second side portion.

28. A cutting device according to claim 22, further comprising:

a means for securing said first and second handles rigidly in said closed position by hand and for permitting said first and second handles to move to said open position by hand.

29. A cutting device according to claim 21, wherein said gripping member includes a protecting portion overlapping said securing and releasing mechanism.

30. A cutting device according to claim 17, wherein each of said first and second side sections of said gripping member extend upwardly from said bottom section of said gripping portion to approximately half way to a top of said cutting device.

31. A cutting device according to claim 23, wherein each of said first and second side portions of said gripping element extend upwardly from said bottom portion of said gripping element to approximately half way to a top of said cutting device.

32. A cutting device according to claim 22, wherein said bottom portion is split by a plane that is substantially perpendicular to said pivot axis, and said first and second side portions are positioned on opposite sides of said plane.

33. A utility knife comprising:

first and second handle members pivotally connected to one another, said members being pivotally movable between opened and closed positions about a pivot axis, said handle member being lockable in said closed position, said first handle member including a rear portion having laterally spaced, vertical side wall portions and a bottom wall portion defining a blade storage pocket, said second handle member having a rearward portion for closing off said blade storage pocket, said bottom wall portion extending transversely between said vertical side wall portions and being intersected by a plane that is substantially perpendicular to said pivot axis, each of said vertical side wall portions being positioned on an opposite side of said plane.

34. A utility knife according to claim 33, wherein said rear portion of said first handle member has an outer elastomeric grip on said side wall portions and said bottom wall portion.

35. A utility knife according to claim 34, wherein said side wall portions and said bottom wall portion comprise an underlying plastic layer.

36. A utility knife according to claim 35, wherein one of said side wall portions comprises a metal wall structure underlying said plastic layer.

37. A utility knife according to claim 36, wherein said second handle member is made of metal.

38. A cutting device according to claim 17, wherein each of said first side portion of said first handle and said first side section of said gripping surface form an exterior surface of said first side of said cutting device for contact with a user's hand when said first and second handle members are in said closed position, and each of said second side portion of said second handle and said second side section of said gripping surface form a second exterior surface of said second side of said cutting device for contact with a user's hand when said first and second handle members are in said closed position.

39. A cutting device according to claim 22, wherein said first side portion of said first handle member forms an exterior surface of said first side of said cutting device for contact with a user's hand when said first and second handle members are in said closed position, and each of said second side portion of said first handle member and said second handle member forms an exterior surface of said second side of said cutting device for contact with a user's hand when said first and second handle members are in said closed position.

* * * * *